US009436108B2

(12) United States Patent
Kodama et al.

(10) Patent No.: US 9,436,108 B2
(45) Date of Patent: Sep. 6, 2016

(54) ELECTROPHOTOGRAPHIC PHOTORECEPTOR

(71) Applicant: Konica Minolta, Inc., Tokyo (JP)

(72) Inventors: Daisuke Kodama, Hino (JP); Toshiyuki Fujita, Hachioji (JP); Hirofumi Hayata, Fuchu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/640,764

(22) Filed: Mar. 6, 2015

(65) Prior Publication Data

US 2015/0261107 A1 Sep. 17, 2015

(30) Foreign Application Priority Data

Mar. 14, 2014 (JP) ..... 2014-051309

(51) Int. Cl.
*G03G 5/147* (2006.01)

(52) U.S. Cl.
CPC ..... *G03G 5/14791* (2013.01); *G03G 5/14704* (2013.01)

(58) Field of Classification Search
CPC . G03G 5/14704; G03G 5/08; G03G 5/14791
USPC ..... 430/58.1, 66
See application file for complete search history.

(56) References Cited

U.S. PATENT DOCUMENTS 4,477,549 A * 10/1984 Fujimaki ..... G03G 5/08214 430/66
8,119,314 B1 * 2/2012 Heuft ..... G03G 5/0589 430/58.05
8,697,322 B2 * 4/2014 Cote ..... G03G 5/0589 430/66
2008/0260427 A1 * 10/2008 Iwanaga ..... G03G 5/14704 430/66
2011/0217642 A1 * 9/2011 Heuft ..... G03G 5/04 430/58.05
2013/0157182 A1 * 6/2013 Fujita ..... G03G 5/043 430/57.1
2014/0377694 A1 * 12/2014 Shibata ..... G03G 5/14704 430/56

FOREIGN PATENT DOCUMENTS

JP 20060267931 A 10/2006
JP 2010-164646 A 7/2010

OTHER PUBLICATIONS

Notice of Reasons for Rejection; date of mailing: Feb. 9, 2016; Patent Application No. 2014-051309; Applied Provisions: Articles 29(1), 29(2), and 36; total of 4 pages. English translation of Notice of Reasons for Rejection; total of 6 pages; Grand Total of 10 pages.

* cited by examiner

*Primary Examiner* — Christopher Rodee
(74) *Attorney, Agent, or Firm* — Lucas & Mercanti, LLP

(57) ABSTRACT

An electrophotographic photoreceptor includes an electrically conductive support, a photosensitive layer formed on the electrically conductive support and a surface layer formed on the photosensitive layer. The surface layer contains a resin produced by polymerizing a cross-linkable polymerizable compound, N-type semiconductor fine particles and P-type semiconductor fine particles.

11 Claims, 1 Drawing Sheet

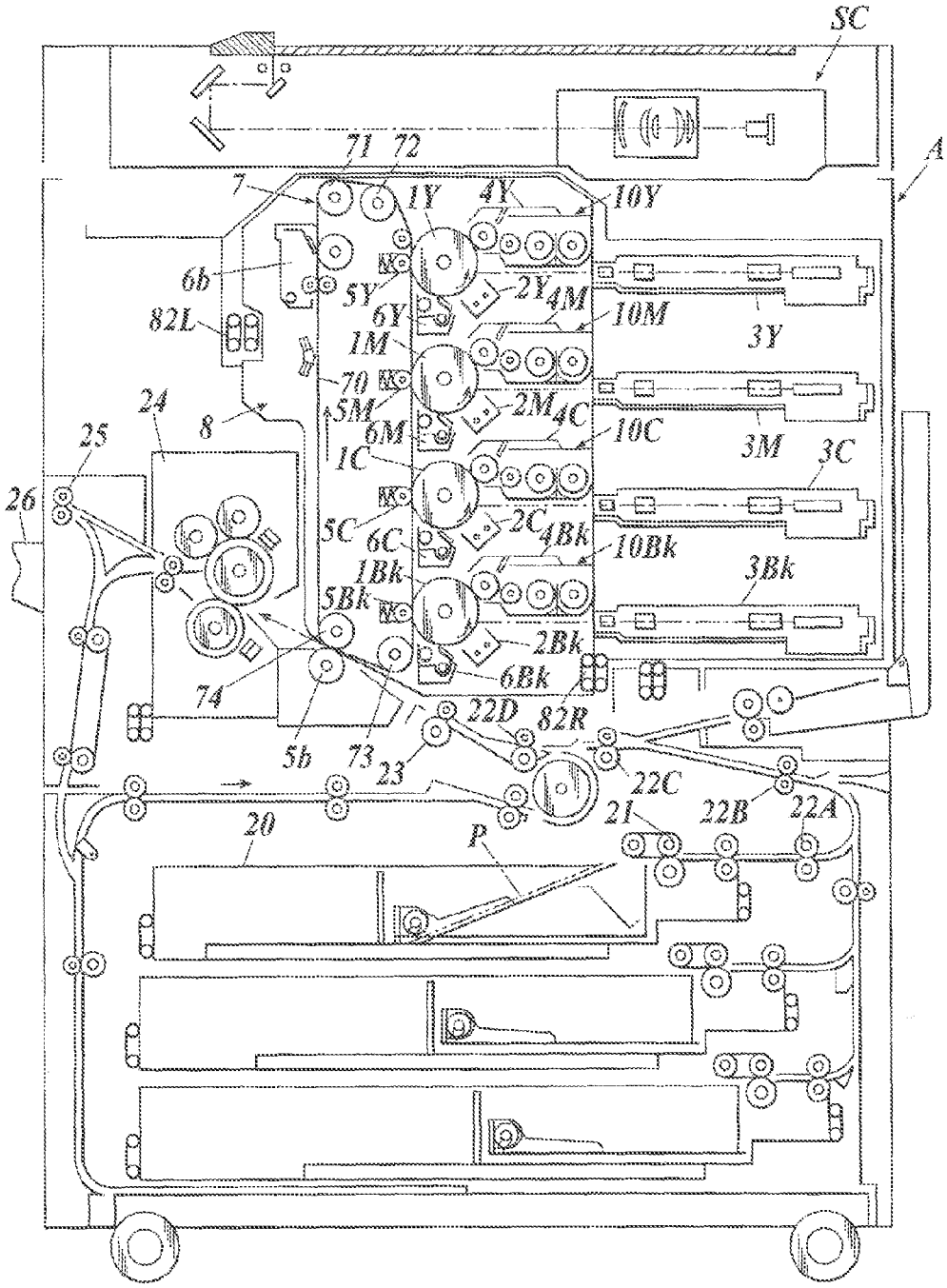
SC
A
71
72
7
1Y
4Y
10Y
6b
5Y
2Y
4M
10M
3Y
82L
6Y
1M
70
5M
2M
4C
10C
3M
3C
24
8
25
6M
1C
26
5C
6C
2C
4Bk
10Bk
3Bk
1Bk
5Bk
2Bk
6Bk
74
22D
82R
5b
73
23
22C
21
22B
22A
20
P

ELECTROPHOTOGRAPHIC PHOTORECEPTOR

BACKGROUND OF THE INVENTION

1. Field of the Invention

The present invention relates to an electrophotographic photoreceptor used for an electrophotographic image forming apparatus.

2. Description of Related Art

Inorganic and organic electrophotographic photoreceptors (hereinafter also simply referred to as "photoreceptors") have been conventionally known as photoreceptors that are used for electrophotographic image forming apparatuses.

The term "electrophotographic" typically refers to an image forming process in which an image is formed by charging a photoconductive photoreceptor in the dark by means of, for example, corona discharge, then exposing it to light to dissipate the charges selectively in the exposed part so as to obtain an electrostatic latent image, and developing the latent image with a toner composed of a coloring agent such as dyes and pigments, a resin material and the like so as to visualize the image.

Compared to inorganic photoreceptors, organic photoreceptors are advantageous in flexibility in photosensitive wavelength range, ease of film forming, flexibility, film transparency, suitability for mass-production, toxicity, production cost and the like. Accordingly, organic photoreceptors are now used in most photoreceptors.

In recent years, organic photoreceptors with higher durability and higher image quality have been required.

For example, with the aim of achieving high abrasion resistance of a photoreceptor and forming an high-quality image, JP 2010-164646A proposes an photoreceptor in which an N-type semiconductor fine particles that have an electron transporting function and are made of aluminum oxide, titanium dioxide, tin oxide or the like are added to a cross-linked surface layer.

However, since such photoreceptors exhibit increasing residual potential after exposure when they are repeatedly used, they cannot stably form high-quality images for a long period of time. It is presumed this is because holes generated in a charge generating layer are trapped in the interface between a charge transporting layer and a surface layer and in the interface of particles of the surface layer due to the lack of a hole transporting function of the N-type semiconductor particles, and the holes cannot therefore effectively cancel negative charges on the photoreceptor surface.

Another photoreceptor known in the art is a photoreceptor in which an organic compound having a hole transporting function is added to a cross-linked surface layer. Photoreceptors of this type initially exhibit reduced residual potential, but the organic compound deteriorates and loses the function after repeated use, and the advantageous effect is eventually not exerted. Further, organic compounds having a hole transporting function generally have a plasticizing function, which reduces the film hardness of a surface layer.

Yet another photoreceptor known in the art is a photoreceptor in which P-type semiconductor particles are added to a cross-linked surface layer. However, it is difficult to reduce the residual potential to a sufficiently low level by using photoreceptors of this type because the hole transporting function is inferior to the electron transporting function (the hole mobility is lower than the electron mobility).

SUMMARY OF THE INVENTION

The present invention was made in view of the above circumstances, and an object thereof is to provide an electrophotographic photoreceptor that maintains the residual potential after exposure at a low level even after repeated use and also has high durability.

In order to realize the above object, according to a first aspect of the present invention, there is provided an electrophotographic photoreceptor including an electrically conductive support, a photosensitive layer formed on the electrically conductive support and a surface layer formed on the photosensitive layer, wherein the surface layer contains a resin produced by polymerizing a cross-linkable polymerizable compound, N-type semiconductor fine particles and P-type semiconductor fine particles.

Preferably, in the surface layer, a mass ratio of the P-type semiconductor fine particles to the N-type semiconductor fine particles (part by mass of the P-type semiconductor fine particles/part by mass of the N-type semiconductor fine particles) is within a range of 0.1 to 0.8.

Preferably, the N-type semiconductor fine particles are constituted by $SnO_2$, and the P-type semiconductor fine particles are constituted by $CuMO_2$, where M is Al, Ga or In.

Preferably, the N-type semiconductor fine particles are constituted by any one of $SnO_2$, $TiO_2$ and $Al_2O_2$.

Preferably, the N-type semiconductor fine particles are constituted by $SnO_2$.

Preferably, a number average primary particle size of the N-type semiconductor fine particles is within the range of 1 to 300 nm.

Preferably, the N-type semiconductor fine particles are contained in an amount of 30 to 250 parts by mass with respect to 100 parts by mass of a surface layer binder resin.

Preferably, the P-type semiconductor fine particles are constituted by $CuMO_2$, where M is Al, Ga or In.

Preferably, the P-type semiconductor fine particles are constituted by $CuAlO_2$.

Preferably, a number average primary particle size of the P-type semiconductor fine particles is within the range of 1 to 300 nm.

Preferably, the P-type semiconductor fine particles are contained in an amount of 1 to 250 parts by mass with respect to 100 parts by mass of a surface layer binder resin.

Preferably, in the surface layer, a mass ratio of the P-type semiconductor fine particles to the N-type semiconductor fine particles (part by mass of the P-type semiconductor fine particles/part by mass of the N-type semiconductor fine particles) is within a range of 0.2 to 0.7.

In the electrophotographic photoreceptor of the present invention, the surface layer contains the resin produced by polymerizing the cross-linkable polymerizable compound, the N-type semiconductor fine particles and the P-type semiconductor fine particles. Accordingly, the photoreceptor maintains the residual potential after exposure at a low level even after repeated use while it also has high durability.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein:

FIG. 1 is an explanatory cross sectional view of an image forming apparatus that is provided with an electrophotographic photoreceptor of the present invention, illustrating an example of the configuration thereof.

DETAILED DESCRIPTION OF THE PREFERRED EMBODIMENT

Hereinafter, an embodiment of the present invention will be described with reference to the drawings. Though various technical limitations which are preferable to perform the present invention are included in the after-mentioned embodiment, the scope of the invention is not limited to the following embodiment and the illustrated examples.

Electrophotographic Photoreceptor

The photoreceptor of the present invention is not particularly limited in layer configuration as long as a photosensitive layer is formed on an electrically conductive support, and a surface layer is further formed on the photosensitive layer. Specific examples of such layer configurations include the following configurations (1) and (2) in which a photosensitive layer and a surface layer are laminated in the above-described order.

(1) A layer configuration in which an intermediate layer, a photosensitive layer composed of a charge generating layer and a charge transporting layer, and a surface layer are laminated on an electrically conductive support in the written order.

(2) A layer configuration in which an intermediate layer, a single photosensitive layer containing a charge generating material and a charge transporting material, and a surface layer are laminated on an electrically conductive support in the written order.

The photoreceptor of the present invention is an organic photoreceptor. As used herein, the term "organic photoreceptor" means an electrophotographic photoreceptor in which at least one of the essential features thereof, namely a charge generating function and/or a charge transporting function, is imparted by an organic compound. Organic photoreceptors include photoreceptors containing an organic charge generating material or an organic charge transporting material known in the art, photoreceptors containing a polymer complex that has a charge generating function and a charge transporting function, and the like.

Surface Layer

The surface layer of the photoreceptor of the present invention contains a resin produced by polymerizing a cross-linkable polymerizable compound (hereinafter also referred to as a "surface layer binder resin"), N-type semiconductor fine particles and P-type semiconductor fine particles.

In the photoreceptor of the present invention, the resin of the surface layer produced by polymerizing the cross-linkable polymerizable compound imparts a fundamental high film hardness, and the N-type semiconductor fine particles and the P-type semiconductor fine particles contained in the surface layer further increases the film hardness by the action of a filler effect. Further, in the present invention, the photoreceptor has both electron transporting function and hole transporting function due to the combination use of the N-type semiconductor fine particles and the P-type semiconductor fine particles. Accordingly, the residual potential is maintained at a low level even after repeated use.

In general, as the amount of metal oxide fine particles added in a surface layer is increased, the electrical conductivity of the surface layer increases, and the surface layer can hold less negative charges. As a result, it becomes difficult to achieve good dot reproducibility. Particularly under a high-temperature high-humidity environment, not only the metal oxide fine particles exhibit higher electrical conductivity, but also moisture in the air is adsorbed on hydroxyl groups existing on the surface of the metal oxide particles so as to decrease the resistance. As a result, the dot reproducibility is further deteriorated. Although the details have not been revealed yet, when $CuAlO_2$, which serves as P-type semiconductor fine particles, is used alone, a good dot reproducibility cannot be obtained under a high-temperature high-humidity environment. In contrast, in the present invention, the combination use of the P-type semiconductor fine particles and the N-type semiconductor fine particles produces good dot reproducibility.

Surface Layer Binder Resin

The surface layer binder resin of the surface layer is produced by polymerizing the cross-linkable polymeric compound. Specific examples of such cross-linkable polymeric compounds include polymerizable compounds having two or more radical polymerizable functional groups (hereinafter, also referred to as "polyfunctional radical polymerizable compounds"). Such surface layer binder resins are formed by polymerizing and curing a polyfunctional radical compound by means of active ray irradiation such as ultraviolet ray and electron beam.

As the monomer of the surface layer binder resin, a compound having one radical polymerizable functional group (hereinafter also referred to as a "monofunctional radical polymerizable compound) may be used in combination with a polyfunctional radical polymerizable compound. When a monofunctional radical polymerizable monomer is used, the ratio thereof is preferably equal to or less than 20 mass % with respect to the total amount of the monomers of the surface layer binder resin.

Examples of radical polymerizable functional groups include a vinyl group, an acryloyl group, a methacryloyl group and the like.

Particularly preferred multifunctional radical polymerizable compounds are acrylic monomers that have two or more acryloyl groups ($CH_2{=}CHCO{-}$) or methacryloyl groups ($CH_2{=}CCH_3CO{-}$) as the radical polymerizable functional groups, and the oligomers thereof, because they can cure by a small amount of light or for a short period of time. Accordingly, preferred resins are acrylic resins that are produced from such acrylic monomers or oligomers.

In the present invention, such polyfunctional radical polymerizable compounds may be used alone or in combination. Further, such polyfunctional radical polymerizable compounds may be used in the form of either monomer or oligomer.

Specific examples of the multifunctional radical polymerizable compounds are described below.

M1

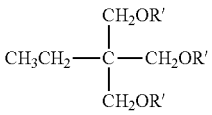

M2

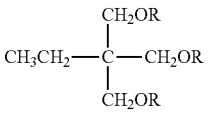

M3

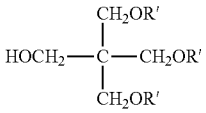

-continued

M4

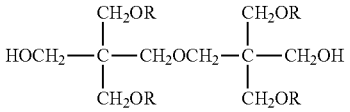

M5

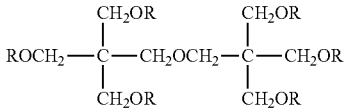

M6

$CH_3CH_2C(CH_2OC_3H_6OR)_3$

M7

$CH_3CH_2C(CH_2CH_2OR)_3$

M8

$R(OC_3H_6)_3OR$

M9

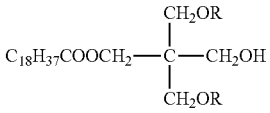

M10

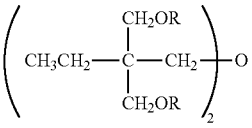

M11

$(ROCH_2)_4C$

M12

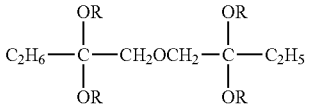

M13

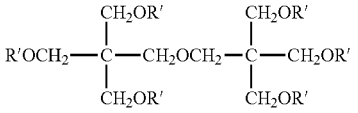

M14

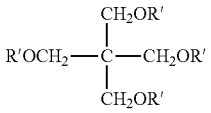

In the above-described chemical formulae of example compounds (M1) to (M14), R is an acryloyl group ($CH_2{=}CHCO{-}$) and R' is a methacryloyl group ($CH_2{=}CCH_3CO{-}$).

N-Type Semiconductor Fine Particles

The N-type semiconductor fine particles of the surface layer transport charges by using electrons as a carrier.

Examples of N-type semiconductor fine particles that can be used in the present invention include $SnO_2$, $TiO_2$, $Al_2O_3$ and the like. In terms of the hardness, the electrical conductivity and the optical transparency of the surface layer, $SnO_2$ is preferred.

The number average primary particle size of the N-type semiconductor fine particles is preferably 1 to 300 nm, more preferably 5 to 200 nm.

In the present invention, the number average primary particle size of the N-type semiconductor fine particles is measured as follows.

Photographs enlarged at 100000-times magnification are taken by means of a scanning electron microscope (e.g. JSM-7500F, JEOL, Ltd.). The photographic images of randomly selected 300 particles (excluding aggregates), which are scanned in a scanner, are analyzed by an automatic image processing analyzer "LUZEX AP (software version 1.32)" (Nireco Corporation) to determine the number average primary particle size.

The N-type semiconductor fine particles are contained in the ratio of preferably 30 to 250 parts by mass, more preferably 50 to 200 parts by mass with respect to 100 parts by mass of the surface layer binder resin.

N-type semiconductor fine particles that can be used include those produced by any general method such as a gas phase method, a chlorine method, a sulfuric acid method, a plasma method and an electrolytic method.

P-Type Semiconductor Fine Particles

The P-type semiconductor particles of the surface layer transport charges by using holes as the carrier.

Examples of P-type semiconductor fine particles that can be used in the present invention include $CuMO_2$ (where M is Al, Ga or In) and the like.

The number average primary particle size of the P-type semiconductor fine particles is preferably 1 to 300 nm, particularly 5 to 200 nm.

In the present invention, the number average primary particle size of the P-type semiconductor fine particles is measured as follows.

Photographs enlarged at 100000-time magnification are taken by means of a scanning electron microscope (e.g. JSM-7500F, JEOL, Ltd.). The photographic images of randomly selected 300 particles (excluding aggregates), which are scanned in a scanner, are analyzed by an automatic image processing analyzer "LUZEX AP (software version 1.32)" (Nireco Corporation) to determine the number average primary particle size.

The P-type semiconductor fine particles are contained in the ratio of preferably 1 to 250 parts by mass, more preferably 5 to 200 parts by mass with respect to 100 parts by mass of the surface layer binder resin.

The P-type semiconductor fine particles can be prepared by, for example, a sintering method. Specifically, when $CuAlO_2$ is used as the P-type semiconductor fine particles, $Al_2O_2$ (99.9% purity) and $Cu_2O$ (99.9% purity) are mixed together in a molar ratio of 1:1, and the mixture is calcined at a temperature of 1100° C. under an Ar atmosphere for 4 days. Then, the mixture is formed into pellets and is sintered at 1100° C. for 2 days so that a sintered body is obtained. Thereafter, the sintered body is roughly grinded to several hundred μm, and the obtained course particles are finely grinded with a wet- and medium-type dispersing machine using a solvent. $CulAlO_2$ having a desired particle size can be thus obtained.

Another method for producing the P-type semiconductor fine particles is, for example, a plasma method. Such plasma methods include a DC plasma arc method, a high frequency plasma method, a plasma jet method and the like.

In the plasma arc method, a metal alloy is used as a consumption anode. A plasma flame is generated from a cathode. The metal alloy of the anode is then heated and evaporated, and the metal alloy vapor is oxidized and cooled. The P-type semiconductor fine particles can be thus obtained.

The high frequency plasma method utilizes a thermal plasma that is generated by heating a gas under the atmospheric pressure by means of high frequency induction discharge. Among high frequency plasma methods, ultrafine particles can be obtained by a plasma evaporating method in which solid particles are injected to an inert gas plasma center and are evaporated while they are passing through the plasma, and the high temperature vapor is quenched and condensed.

In plasma methods, arc discharge is caused in an atmosphere of argon, i.e. an inert gas, or of a diatomic molecule such as hydrogen, nitrogen and oxygen to generate argon plasma, hydrogen plasma or the like. Hydrogen (nitrogen, oxygen) plasma, which is generated by dissociation of the biatomic molecule gas, is extremely reactive compared to the molecular gas, and is therefore also referred to as reactive arc plasma distinctively from inter gas plasma. Among them, an oxygen plasma method is advantageous in producing the P-type semiconductor fine particles.

In the surface layer, the mass ratio of the P-type semiconductor fine particles to the N-type semiconductor fine particles (the parts by mass of the P-type semiconductor fine particles/the parts by mass of the N-type semiconductor fine particles) is preferably within the range of 0.1 to 0.8, more preferably within the range of 0.2 to 0.7.

When the ratio of the P-type semiconductor fine particles to the N-type semiconductor fine particles is within the above-described range, the potential stability and the dot reproducibility are maintained at a high level for a long period of time.

In the present invention, the surface of the N-type semiconductor fine particles and the P-type semiconductor fine particles may be treated with a surface treatment agent having a radical polymerizable functional group. Specifically, a fine particle material (hereinafter also referred to as "crude fine particles") is surface-treated with the surface treatment agent having a radical polymerizable functional group so that the radical polymerizable functional groups are introduced on the surface of the crude fine particles.

Preferred surface treatment agents are those reactive with hydroxyl groups or the like that exist on the surface of the N-type semiconductor fine particles and the P-type semiconductor fine particles. Examples of such surface treatment agents include silane coupling agents, titanium coupling agents and the like.

In the surface treatment agent having a radical polymerizable functional group, examples of such radical polymerizable reactive groups include a vinyl group, an acryloyl group, a methacryloyl group and the like. These radial polymerizable reactive groups can also react with the polymerizable compound (polyfunctional radical polymerizable compound) of the surface layer binder resin so as to form the robust surface layer.

Preferred surface treatment agents having a radical polymerizable reactive group are silane coupling agents that have a radical polymerizable reactive group such as a vinyl group, an acryloyl group and a methacryloyl group.

Specific examples of the surface treatment agent are described below.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)\ Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2\ (OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

In addition to the above-described example compounds (S-1) to (S-36), other silane compounds having a radical polymerizable functional group may also be used as the surface treatment agent.

The surface treatment agent may be constituted of a single compound or a combination of two or more compounds.

The amount of the surface treatment agent used is preferably 0.1 to 200 parts by mass, more preferably 7 to 70 parts by mass with respect to 100 parts by mass of the crude fine particles.

Examples of surface treatment methods that can be used include wet cracking of a slurry (suspension of solid particles) that contains the crude fine particles and the surface treatment agent. This method prevents re-aggregation of the crude fine particles and also promotes the surface treatment of the crude fine particles at the same time. Thereafter, the solvent is removed, and the fine particles are pulverized.

Examples of surface treatment machines that can be used include a wet- and medium-type dispersing machine. A wet- and medium-type dispersing machine grinds and disperses aggregates of the crude fine particles by rapidly spinning agitation disks orthogonally coupled to a rotation axis in a container in which beads are charged as a medium. Such dispersing machines may be of any type that can sufficiently disperse the crude fine particles during the surface treatment of the crude fine particles and can also perform the surface treatment, such as either vertical/horizontal type and either continuous/batch type. Specifically, a sand mill, an Ultravisco mill, a pearl mill, a grain mill, a Dyno mill, an agitator mill, a dynamic mill, or the like can be used. These dispersing machines use a grinding medium such as balls and beads to perform fine grinding and dispersion by the action of impact crush, friction, shear, shear stress and the like.

The beads used in the wet- and medium-type dispersing machine may be constituted by balls made of glass, alumina, zircon, zirconia, steel, flint stone and the like. Zirconia or zircon balls are particularly preferred. The typical size of the beads is approximately 1 to 2 mm in diameter. However, in the present invention, a preferred size is approximately 0.1 to 1.0 mm.

The disks and the inner wall of the container of the wet- and medium-type dispersing machine may be made of various materials such as stainless steel, nylon and ceramics. In the present invention, it is particularly preferred that the disks and the container inner wall are made of ceramics such as zirconia and silicon carbide.

The surface layer of the present invention may contain other components in addition to the surface layer binder resin, the N-type semiconductor fine particles and the P-type semiconductor fine particles. For example, various antioxidants and various lubricant particles such as fluorine-containing resin particles may be added. Preferred fluorine-containing resin particles are those made of a single resin or two or more resins selected from tetrafluoroethylene resins, chlorotrifluoroethylene resins, chlorohexafluoroethylene-propylene resins, vinyl fluoride resins, vinylidene fluoride resins, dichlorodifluoroethylene resins and the copolymers thereof. Tetrafluoroethylene resins and vinylidene fluoride resins are particularly preferred.

The layer thickness of the surface layer is preferably 0.2 to 10 μm, more preferably 0.5 to 6 μm.

Hereinafter, the components other than the surface layer of the photoreceptor with the above-described layer configuration (1) will be described.

Electrically Conductive Support

The electrically conductive support of the present invention may be constituted by any electrically conductive material. Examples of such supports include a drum or a sheet of metal such as aluminum, copper, chromium, nickel, zinc, stainless or the like, a plastic film laminated with a metal foil of aluminum, copper or the like, a plastic film with a vapor-deposition coating of aluminum, indium oxide, tin oxide or the like, a metal, plastic or paper body with an electrically conductive layer that is formed by applying a conductive material alone or together with a binder resin.

Intermediate Layer

In the photoreceptor of the present invention, an intermediate layer having a barrier function and an adhesion function may be provided between the electrically conductive support and the photosensitive layer. To prevent various failures, it is preferred to provide an intermediate layer.

The intermediate layer contains, for example, a binder resin (hereinafter referred to as an "intermediate layer binder resin"), and if necessary, further contains electrically conductive particles and metal oxide particles.

Examples of such intermediate layer binder resins include casein, polyvinylalcohol, nitrocellulose, ethylene-acrylate copolymers, polyamide resins, polyurethane resins, gelatin and the like. Among them, alcohol-soluble polyamide resins are preferred.

In order to adjust the resistance, the intermediate layer may contain various types of electrically conductive particles and metal oxide particles. For example, metal oxide fine particles of alumina, zinc oxide, titanium oxide, tin oxide, antimony oxide, indium oxide, bismuth oxide and the like may be used. Further, ultrafine particles of tin-doped indium oxide, antimony-doped tin oxide, zirconium oxide and the like may be used.

The number average particle size of such metal oxide particles is preferably equal to or less than 0.3 μm, more preferably equal to or less than 0.1 μm.

These metal oxide particles may be used alone or in combination of two or more. When two or more types of metal oxide particles are mixed, they may be in the form of solid solution or fusion.

The electrically conductive particles or metal oxide particles is contained in the ratio of preferably 20 to 400 parts by mass, more preferably 50 to 350 parts by mass with respect to 100 parts by mass of the intermediate layer binder resin.

The layer thickness of the intermediate layer is preferably 0.1 to 15 μm, more preferably 0.3 to 10 μm.

Charge Generating Layer

The charge generating layer of the photosensitive layer, which constitutes the photoreceptor of the present invention, contains a charge generating material and a binder resin (hereinafter also referred to as a "charge generating layer binder resin").

Examples of such charge generating materials include, but are not limited to, azo materials such as Sudan Red and Dyan Blue, quinone pigments such as pyrenequinone and anthanthrone, quinocyanine pigments, perylene pigments, indigo pigments such as indigo and thioindigo, polycyclic quinone pigments such as pyranthrone and diphthaloylpyrene, phthalocyanine pigments and the like. Among them, polycyclic quinone pigments and titanyl phthalocyanine pigments are preferred. These charge generating materials may be used alone or in combination of two or more.

The charge generating layer binder resin may be a resin known in the art. Examples of such resins include, but are not limited to, polystyrene resins, polyethylene resins, polypropylene resins, acrylic resins, methacrylic resins, vinyl chloride resins, vinyl acetate resins, polyvinylbutyral resins, epoxy resins, polyurethane resins, phenol resins, polyester resins, alkyd resins, polycarbonate resins, silicone resins, melamine resins, the copolymer resins including two or more of these resins (e.g. vinyl chloride-vinyl acetate copolymer resins, vinyl chloride-vinyl acetate-maleic anhydride copolymer resins), polyvinylcarbazole resins and the like. Among them, polyvinylbutyral resins are preferred.

The charge generating material is contained in the charge generating layer in the ratio of preferably 1 to 600 parts by mass, more preferably 50 to 500 parts by mass with respect to 100 parts by mass of the charge generating layer binder resin.

The layer thickness of the charge generating layer varies depending on the properties of the charge generating material, the properties and the content of the charge generating layer binder resin, and the like. However, it is preferably 0.01 to 5 μm, more preferably 0.05 to 3 μm.

Charge Transporting Layer

The charge transporting layer of the photosensitive layer, which constitutes the photoreceptor of the present invention, contains a charge transporting material and a binder resin (hereinafter also referred to as a "charge transporting layer binder resin").

Regarding the charge transporting material of the charge transporting layer, examples of such materials capable of transporting charges include triphenylamine derivatives, hydrazone compounds, styryl compounds, benzidine compounds, butadiene compounds and the like.

The charge transporting layer binder resin may be a resin known in the art. Such resins include polycarbonate resins, polyacrylate resins, polyester resins, polystylene resins, stylene-acrylonitrile copolymer resins, polymethacrylate resins, stylene-methacrylate copolymer resins and the like, of which polycarbonate resins are preferred. Furthermore, polycarbonate resins of BPA (bisphenol A), BPZ (bisphenol Z), dimethyl BPA, BPA-dimetyl BPA copolymer and the like are preferred in terms of anti-crack property, abrasion resistance and charging properties.

The charge transporting material is contained in the charge transporting layer in the ratio of preferably 10 to 500 parts by mass, more preferably 20 to 250 parts by mass with respect to 100 parts by mass of the charge transporting layer binder resin.

The layer thickness of the charge transporting layer varies depending on the properties of the charge transporting material, the properties and content of the charge transporting layer binder resin. However, it is preferably 5 to 40 μm, more preferably 10 to 30 μm.

An antioxidant, an electron conductive agent, a stabilizer, a silicone oil and the like may be added to the charge transporting layer. Preferred antioxidants are disclosed in JP 2000-305291A and the like, and preferred electron conductive agents are disclosed in JP S50-137543A, JP 558-76483A and the like.

Method for Producing Photoreceptor

As an example of the production method, the photoreceptor of the present invention may be produced through the following steps.

Step 1: forming the intermediate layer by applying a coating fluid for forming the intermediate layer on the outer circumferential side of the electrically conductive support, and drying it.

Step 2: forming the charge generating layer by applying a coating fluid for forming the charge generating layer on the outer circumferential side of the intermediate layer that is formed on the conductive support, and drying it.

Step 3: forming the charge transporting layer by applying a coating fluid for forming the charge transporting layer on the outer circumferential side of the charge generating layer that is formed on the intermediate layer, and drying it.

Step 4: forming the surface layer by applying a coating fluid for forming the surface layer on the outer circumferential side of the charge transporting layer that is formed on the charge generating layer so as to form a coated film, and polymerizing the coated film.

STEP 1: Forming Intermediate Layer

The intermediate layer can be formed by dissolving the intermediate layer binder resin in a solvent to prepare a coating fluid (hereinafter also referred to as an "intermediate layer forming coating fluid"), if necessary, dispersing the electrically conductive particles and the metal oxide particles in the fluid, thereafter applying the coating fluid on the electrically conductive support to a certain thickness so as to form a coated film, and drying the coated film.

To disperse the electrically conductive particles and the metal oxide particles in the intermediate layer forming coating fluid, an ultrasonic dispersing machine, a ball mill, a sand mill, a homo mixer or the like may be used, but the means is not limited thereto.

The intermediate layer forming coating fluid may be applied by a method known in the art. Examples of such methods include immersion coating, spray coating, spinner coating, bead coating, blade coating, beam coating, a slide hopper method, a circular slide hopper method and the like.

The drying method of the coated film may be suitably selected according to the type of the solvent and the film thickness. However, thermal drying is preferred.

The solvent used in the step of forming the intermediate layer may be any solvent that can adequately disperse the electrically conductive particles and metal oxide particles and dissolve the intermediate layer binder resin. Specifically, alcohols of 1 to 4 carbons such as methanol, ethanol, n-propyl alcohol, isopropyl alcohol, n-butanol, t-butanol and sec-butanol are preferred because they have high resolvability of the binder resin and high application suitability. Further, an auxiliary solvent can be used in combination with the above solvent in order to improve the shelf stability and the particle dispersibility. Such solvents that can produce favorable effects include benzyl alcohol, toluene, methylene chloride, cyclohexanone, tetrahydrofurane, and the like.

The concentration of the intermediate layer binder resin in the intermediate layer forming coating fluid is suitably selected according to the layer thickness and the production rate of the intermediate layer.

STEP 2: Forming Charge Generating Layer

The charge generating layer can be formed by dispersing the charge generating material in a solution of the charge generating layer binder resin in a solvent to prepare a coating fluid (hereinafter also referred to as a "charge generating layer forming coating fluid"), applying the coating fluid on the intermediate layer to a certain thickness to form a coated film, and drying the coated film.

To disperse the charge generating material in the charge generating layer forming coating fluid, for example, a ball mill, a sand mill, a homo mixer or the like can be used, but the means is not limited thereto.

The charge generating layer forming coating fluid may be applied by a method known in the art. Examples of such methods include immersion coating, spray coating, spinner coating, bead coating, blade coating, beam coating, a slide hopper method, a circular slide hopper method and the like.

The drying method of the coated film may be suitably selected according to the type of the solvent and the film thickness. However, thermal drying is preferred.

Examples of solvents that can be used for forming the charge generating layer include, but are not limited to, toluene, xylene, methylene chloride, 1,2-dichloroethane, methylethylketone, cyclohexane, ethyl acetate, t-butyl acetate, methanol, ethanol, propanol, butanol, methylcellosolve, 4-methoxy-4-methyl-2-pentanone, ethylcellosolve, tetrahydrofuran, 1,4-dioxane, 1,3-dioxolane, pyridine, diethylamine and the like.

STEP 3: Forming Charge Transporting Layer

The charge transporting layer can be formed by preparing a coating fluid in which the charge transporting layer binder resin and the charge transporting material are dissolved in a solvent (hereinafter also referred to as a "charge transporting layer forming coating fluid"), applying the coating fluid on the charge generating layer to a certain thickness to form a coated film, and drying the coated film.

The charge transporting layer forming coating fluid may be applied by a method known in the art. Examples of such methods include immersion coating, spray coating, spinner coating, bead coating, blade coating, beam coating, a slide hopper method, a circular slide hopper method and the like.

The drying method of the coated film may be suitably selected according to the type of the solvent and the film thickness. However, thermal drying is preferred.

Examples of solvents that can be used for forming the charge transporting layer include, but are not limited to, toluene, xylene, methylene chloride, 1,2-dichloroethane, methylethylketone, cyclohexane, ethyl acetate, butyl acetate, methanol, ethanol, propanol, butanol, tetrahydrofuran, 1,4-dioxane, 1,3-dioxolane, pyridine, diethylamine and the like.

STEP 4: Forming Surface Layer

The surface layer can be formed by adding the polymerizable compound, the N-type semiconductor fine particles, the P-type semiconductor fine particles and a polymerization initiator, and if necessary other components, to a solvent known in the art so as to prepare a coating fluid (hereinafter also referred to as a "surface layer forming coating fluid"), applying the surface layer forming coating fluid on the outer circumferential face of the charge transporting layer that is formed in Step (3) to form a coated film, drying the coated film, and irradiating it with an active ray such as ultraviolet ray or electron beam to polymerize the polymerizable compound in the coated film.

In the polymerization of the surface layer, it is preferred that the polymerizable compound in the coated film is cured by irradiating it with an active ray to generate radicals so as to cause cross-linking reaction in a molecule and between molecules as well as to cause polymerization reaction, so that a cross-linked cured resin is produced from the polymerizable compound.

In the surface layer forming coating fluid, the N-type semiconductor fine particles are contained in the ratio of preferably 30 to 250 parts by mass, more preferably 50 to 200 parts by mass with respect to 100 parts by mass of the total amount of the monomers for forming the surface layer binder resin (the multifunctional radical polymerizable compound and the monofunctional radical polymerizable compound). Further, the P-type semiconductor fine particles are contained in the ratio of preferably 1 to 250 parts by mass, more preferably 5 to 200 parts by mass with respect to 100 parts by mass of the total amount of the monomers of the surface layer binder resin (the multifunctional radical polymerizable compound and the monofunctional radical polymerizable compound).

In the present invention, it is presumed that the monomers for forming the surface layer binder resin are completely polymerized to constitute the surface layer binder resin.

To disperse the N-type semiconductor fine particles and the P-type semiconductor fine particles in the surface layer forming coating fluid, an ultrasonic dispersing machine, a ball mill, a sand mill, a homo mixer and the like may be used, but the means is not limited thereto.

The solvent that is used for forming the surface layer may be any solvent that can dissolve or disperse the polymerizable compound, the N-type semiconductor fine particles and the P-type semiconductor fine particles. Examples of such solvents include, but are not limited to, methanol, ethanol, n-propyl alcohol, isopropyl alcohol, n-butanol, t-butanol, sec-butanol, benzyl alcohol, toluene, xylene, methylene chloride, methylethylketone, cyclohexane, ethyl acetate, butyl acetate, methyl cellosolve, ethyl cellosolve, tetrahydrofuran, 1,4-dioxane, 1,3-dioxolane, pyridine, diethylamine and the like.

The surface layer forming coating fluid may be applied by a method known in the art. Examples of such methods include immersion coating, spray coating, spinner coating, bead coating, blade coating, beam coating, a slide hopper method, a circular slide hopper method and the like.

The coated film may be cured without drying. However, it is preferred the coated film is cured after natural drying or thermal drying.

The drying conditions may be suitably selected according to the type of the solvent, the film thickness and the like. The drying temperature is preferably room temperature to 180° C., particularly 80° C. to 140° C. The drying time is preferably 1 to 200 minutes, particularly 5 to 100 minutes.

Examples of methods that can be used for polymerizing the polymerizable compound include a method in which cleavage by an electron beam causes the reaction, a method in which a radical polymerization initiator is added and a light or a heat causes the reaction, and the like. The radical polymerization initiator may be either photo polymerization initiator or thermal polymerization initiator. Further, the radical polymerization initiator may be a combination of a photo polymerization initiator and a thermal polymerization initiator.

The radical polymerization initiator is preferably a photopolymerization initiator. Among photopolymerization initiators, alkylphenenone compounds and phosphineoxide compounds are particularly preferred. In particular, compounds having an α-hydroxyacetophenone structure or an acylphosphineoxide structure are preferred.

Specific examples of such acylphosphineoxide compounds as a photopolymerization initiator are described below.

P 1

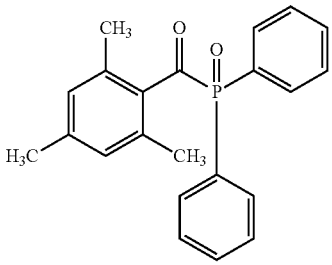

P 2

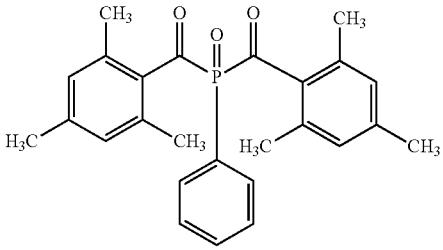

The polymerization initiator may be constituted by a single compound or by a combination of two or more compounds.

The polymerization initiator is added in the ratio of preferably 0.1 to 20 parts by mass, more preferably 0.5 to 10 parts by mass with respect to 100 parts by mass of the polymerizable compound.

In the polymerization, the coated film is cured by irradiating it with an active ray to generate radicals so as to cause a cross-linking reaction to form cross-linkages in a molecule and between molecules as well as to cause a polymerization reaction. A cured resin is thus produced. Preferred active ray is ultraviolet ray and electron beam. Ultraviolet ray is easy to use and is therefore particularly preferred.

The light source of the ultraviolet ray may be any light source that can generate an ultraviolet ray. Examples of light sources that can be used include a low-pressure mercury lamp, a middle-pressure mercury lamp, a high-pressure mercury lamp, an ultrahigh-pressure mercury lamp, a carbon arc lamp, a metal halide lamp, a xenon lamp, a flash (pulse) xenon and the like.

The irradiation conditions vary depending on the type of the lamp used, but the irradiation amount of the active ray is typically 5 to 500 mJ/cm$^2$, preferably 5 to 100 mJ/cm$^2$.

The power output of the lamp is preferably 0.1 to 5 kW, particularly 0.5 to 3 kW.

The light source of the electron beam may be any electron beam irradiation device. Typically, a curtain-type electron beam accelerator is effectively used for electron beam irradiation of this purpose because of the relatively low cost and the high power output. The acceleration voltage of the electron beam irradiation is preferably 100 to 300 kV. The absorbed irradiation is preferably 0.5 to 10 Mrad.

The irradiation time of the active lay that satisfies the required irradiation amount is preferably 0.1 second to 10 minutes, more preferably 0.1 second to 5 minutes in terms of work efficiency.

In the step of forming the surface layer, the drying may be performed before, after or during irradiation of the active lay. The timing of the drying may be any suitable combination of these timings.

Since the photoreceptor as described above contains the resin produced by polymerizing the cross-linkable polymerizable compound, the N-type semiconductor fine particles and the P-type semiconductor fine particles, it maintains the residual potential after exposure at a low level even after repeated use and also has high durability.

Image Forming Apparatus

The photoreceptor of the present invention is applicable to general electrophotographic image forming apparatuses. An example of such image forming apparatuses is constituted of a photoreceptor, a charging means for charging the surface of the photoreceptor, an exposing means for forming an electrostatic latent image on the surface of the photoreceptor, a developing means for developing the electrostatic latent image by a toner to form a toner image, a transferring means for transferring the toner image onto a transfer object, a fixing means for fixing the toner image transferred on the transfer object, and a cleaning means for removing a residual toner on the photoreceptor.

FIG. 1 is an explanatory cross sectional view of an image forming apparatus provided with the photoreceptor of the present invention, illustrating an example of the configuration thereof.

The image forming apparatus, which is of the type called a tandem color image forming apparatus, includes four image forming sections (image forming units) 10Y, 10M, 10C and 10Bk, an endless belt intermediate transfer body unit 7, a paper feeding means 21 and a fixing means 24. In the upper part of a body A of the image forming apparatus, a document image scanner SC is provided.

The image forming unit 10Y for forming a yellow image includes a drum photoreceptor 1Y, and a charging means 2Y, an exposing means 3Y, a developing means 4Y, a primary transfer roller 5Y as a primary transferring means and a cleaning means 6Y that are disposed surrounding the photoreceptor 1Y. The image forming unit 10M for forming a magenta image includes a drum photoreceptor 1M, a charging means 2M, an exposing means 3M, a developing means 4M, a primary transfer roller 5M as a primary transferring means and a cleaning means 6M. The image forming unit 10C for forming a cyan image includes a drum photoreceptor 1C, a charging means 2C, an exposing means 3C, a developing means 4C, a primary transfer roller 5C as a primary transferring means and a cleaning means 6C. The image forming unit 10Bk for forming a black image includes a drum photoreceptor 1Bk, a charging means 2Bk, an exposing means 3Bk, a developing means 4Bk, a primary transfer roller 5Bk as a primary transferring means and a cleaning means 6Bk. In the image forming apparatus of the present invention, the above-described photoreceptor of the present invention is used as the photoreceptors 1Y, 1M, 1C and 1Bk.

The four image forming units 10Y, 10M, 10C and 10Bk include, respectively, the photoreceptors 1Y, 1M, 1C and 1Bk at the respective centers, the charging means 2Y, 2M, 2C and 2Bk, the exposing means 3Y, 3M, 3C and 3Bk, the rotating developing means 4Y, 4M, 4C and 4Bk, and the cleaning means 6Y, 6M, 6C and 6Bk for cleaning the photoreceptors 1Y, 1M, 1C and 1Bk.

The image forming units 10Y, 10M, 10C and 10Bk have the same configuration except for the color of toner images formed on the respective photoreceptors 1Y, 1M, 1C and 1Bk. For the following detailed description, the image forming unit 10Y is taken as an example.

The image forming unit 10Y, in which the charging means 2Y, the exposing means 3Y, the developing means 4Y and the cleaning means 6Y are arranged surrounding the photoreceptor 1Y that serves an image forming body, is configured to form a yellow (Y) toner image on the photoreceptor 1Y. In this embodiment, at least the photoreceptor 1Y, the charging means 2Y, the developing means 4Y and the cleaning means 6Y of the image forming unit 10Y are integrally provided.

The charging means 2Y charges the photoreceptor 1Y at a uniform potential. In the present invention, the charging means may be of contact or non-contact roller charging type.

The exposing means 3Y exposes the photoreceptor 1Y that the charging section 2Y has charged at a uniform potential to light based on an image signal (yellow) so as to form an electrostatic latent image corresponding to a yellow image. The exposing means 3Y may be composed of an array of LEDs aligned in the axis direction of the photoreceptor 1Y and focusing elements, or of a laser optical system.

The developing means 4Y includes, for example, a rotating developing sleeve in which a magnet is embedded to hold a developing agent and a voltage applying device to apply a DC and/or AC bias voltage between the photoreceptor and the developing sleeve.

The fixing means 24 may be of, for example, thermal roller fixing type, which includes a heating roller equipped with an internal heat source and a press roller that is pressed against the heating roller so that a fixing nip is formed.

The cleaning means 6Y includes a cleaning blade and a brush roller disposed at an upstream side of the cleaning blade.

In the electrophotographic image forming apparatus, the photoreceptor may be integrally combined with other component such as the developing means and the cleaning means as a process cartridge (image forming unit) that is attachable/detachable to/from the electrophotographic image forming apparatus body. Further, the photoreceptor may be integrally formed with at least one of the charging means, the exposing means, the developing means, the transfer means, and the cleaning means as a single process cartridge (image forming unit) that is attachable/detachable to/from the apparatus body using a guide means such as a rail of the apparatus body.

The endless belt intermediate transfer unit 7 includes an endless belt intermediate transfer body 70 that is guided and rotatably supported by a plurality of rollers and serves as an endless belt semiconductive secondary image carrier.

Respective color images formed by the image forming units 10Y, 10M, 10C and 10Bk are sequentially transferred onto the rotating endless belt intermediate transfer body 70 by the primary transfer rollers 5Y, 5M, 5C and 5Bk that serve as primary transferring means so that a composite color image is formed. A transfer object P (an image support that holds a fixed final image, e.g. a normal paper, a transparent sheet, etc.), which is housed in a paper feeder cassette 20, is fed by a feeding means 21 and is conveyed through a plurality of intermediate rollers 22A, 22B, 22C and 22D and a resist roller 23 to a secondary transfer roller 5*b* that serves as a secondary transfer means. A color image is then collectively transferred onto the transfer object P (secondary transfer). The transfer object P on which the color image has been transferred is subject to a fixing treatment by the fixing means 24, and eject rollers 25 then pinch the transfer object P to move it to an external eject tray 26. As used herein, supports to which a toner image formed on the photoreceptor is transferred, such as the intermediate transfer body and the transfer object, are collectively referred to as transfer media.

After the color image is transferred to the transfer object P by the secondary transfer roller 5*b* that serves as the secondary transfer means, the endless belt intermediate transfer body 70 releases the transfer object P by self stripping, and the cleaning means 6*b* removes the residual toner thereon.

During an image forming process, the primary transfer roller 5Bk constantly abuts the photoreceptor 1Bk. The other primary transfer rollers 5Y, 5M and 5C abut the respective photoreceptors 1Y, 1M and 1C only during a color image forming process.

The secondary transfer roller 5*b* abuts the endless belt intermediate transfer body 70 only while the transfer object P is passing through it for the secondary transfer.

Further, a housing 8 is configured to be ejectable from the apparatus body A using guide rails 82L and 82R.

The housing 8 includes the image forming units 10Y, 10M, 10C and 10Bk and the endless belt intermediate transfer body unit 7.

The image forming units 10Y, 10M, 10C and 10Bk are aligned in the vertical direction. The endless belt intermediate transfer body unit 7 is disposed on the left side of the photoreceptors 1Y, 1M, 1C and 1Bk in the FIGURE. The endless belt intermediate transfer body unit 7 includes the endless belt intermediate transfer body 70 that is rotatably guided by the rollers 71, 72, 73 and 74, the primary transfer rollers 5Y, 5M, 5C and 5Bk and the cleaning means 6*b*.

While the image forming apparatus illustrated in FIG. 1 is a color laser printer, the present invention is similarly applicable to black and white laser printers and copiers. Further, instead of a laser light source, for example, an LED light source may be used as the exposure light source.

The toner used in the above-described image forming apparatus is not particularly limited, but the shape factor SF of the toner is preferably less than 140, where a shape factor of 100 corresponds to an exact spherical shape. When the shape factor SF is less than 140, good transfer property and the like is achieved, which improves the image quality of resultant images. In terms of improving the image quality, the toner particles of the toner preferably has a volume average particle size of 2 to 8 μm.

The toner particles typically contain a binder resin and a coloring agent, and if required, further contain a releasing agent. Each of the binder resin, the coloring agent and the releasing agent may be made of a material used in conventional toners and is not particularly limited.

The method for producing the toner particles is not particularly limited, and examples of such methods include a typical grinding method, a wet and melt spheronization method performed in a disperse medium, known polymerization methods such as suspension polymerization, disperse polymerization and emulsion polymerization and aggregation, and the like.

Further, inorganic particles such as silica and titania having an average particle size of 10 to 300 nm and a polishing agent having a size of 0.2 to 3 μm may be added to the toner particles as extra additives in a suitable amount. A mixture of the toner particles with a carrier such as ferrite beads having an average particle size of 25 to 45 μm can be used as a binary developer.

EXAMPLES

Hereinafter, the present invention will be described in detail with examples, however the present invention is not limited to the examples. In the following description, the word "part(s)" refers to "part(s) by mass".

Preparation of N-Type Semiconductor Fine Particles 1

Into a wet sand mill (alumina beads, 0.5 mm diameter), 100 parts of "tin oxide ($SnO_2$)" having a number average primary particle size of 20 nm, 30 parts of 3-methacryloxypropyltrimethoxysilane "KBM-503" (Shin-Etsu Chemical Co., Ltd.) as a surface treatment agent and 1000 parts of methyl ethyl ketone were charged, and they were mixed at 30° C. for 6 hours. Thereafter, the methyl ethyl ketone and the alumina beads were removed by filtration, and the filtrate was dried at 60° C. N-type semiconductor fine particles (1) were thus prepared.

Preparation of N-Type Semiconductor Fine Particles 2

Into a wet sand mill (alumina beads, 0.5 mm diameter), 100 parts of "aluminum oxide ($Al_2O_2$)" having a number average primary particle size of 20 nm, 30 parts of 3-methacryloxypropyltrimethoxysilane "KBM-503" (Shin-Etsu Chemical Co., Ltd.) as a surface treatment agent and 1000 parts of methyl ethyl ketone were charged, and they were mixed at 30° C. for 6 hours. Thereafter, the methyl ethyl ketone and the alumina beads were removed by filtration, and the filtrate was dried at 60° C. N-type semiconductor fine particles (2) were thus prepared.

Preparation of N-Type Semiconductor Fine Particles 3

Into a wet sand mill (alumina beads, 0.5 mm diameter), 100 parts of "titanium oxide ($TiO_2$)" having a number average primary particle size of 20 nm, 30 parts of 3-methacryloxypropyltrimethoxysilane "KBM-503" (Shin-Etsu Chemical Co., Ltd.) as a surface treatment agent and 1000 parts of methyl ethyl ketone were charged, and they were mixed at 30° C. for 6 hours. Thereafter, the methyl ethyl ketone and the alumina beads were removed by filtration, and the filtrate was dried at 60° C. N-type semiconductor fine particles (3) were thus prepared.

Preparation of P-Type Semiconductor Fine Particles 1

$Al_2O_3$ (99.9% purity) and $Cu_2O$ (99.9% purity) were mixed in a molar ratio of 1:1, and the mixture was calcined at 1100° C. under an Ar atmosphere for 4 days. Thereafter, the mixture was formed into pellets, and the pellets were sintered at 1100° C. for 2 days so that a sintered body was obtained. Thereafter, the sintered body is roughly grinded to several hundred μm, and the obtained course particles are finely grinded with a wet- and medium-type dispersing machine using a solvent so that $CuAlO_2$ fine particles (1) having a number average primary particle size of 20 nm were obtained.

Into a wet sand mill (alumina beads, 0.5 mm diameter), 100 parts of the obtained fine particles (1), 30 parts of 3-methacryloxypropyltrimethoxysilane "KBM-503" (Shin-Etsu Chemical Co., Ltd.) as a surface treatment agent and 1000 parts of methyl ethyl ketone were charged, and they were mixed at 30° C. for 6 hours. Thereafter, the methyl ethyl ketone and the alumina beads were removed by filtration, and the filtrate was dried at 60° C. P-type semiconductor fine particles (1) were thus prepared.

Preparation of P-Type Semiconductor Fine Particles 2

$Ga_2O_3$ (99.9% purity) and $Cu_2O$ (99.9% purity) were mixed in a molar ratio of 1:1, and the mixture was calcined at 1100° C. under an Ar atmosphere for 4 days. Thereafter, the mixture was formed into pellets, and the pellets were sintered at 1100° C. for 2 days so that a sintered body was obtained. Thereafter, the sintered body is roughly grinded to several hundred μm, and the obtained course particles are finely grinded with a wet- and medium-type dispersing machine using a solvent so that $CuGaO_2$ fine particles (2) having a number average primary particle size of 20 nm were obtained.

Into a wet sand mill (alumina beads, 0.5 mm diameter), 100 parts of the obtained fine particles (2), 30 parts of 3-methacryloxypropyltrimethoxysilane "KBM-503" (Shin-Etsu Chemical Co., Ltd.) as a surface treatment agent and 1000 parts of methyl ethyl ketone were charged, and they were mixed at 30° C. for 6 hours. Thereafter, the methyl ethyl ketone and the alumina beads were removed by filtration, and the filtrate was dried at 60° C. P-type semiconductor fine particles (2) were thus prepared.

Preparation of P-Type Semiconductor Fine Particles 3

$In_2O_3$ (99.9% purity) and $Cu_2O$ (99.9% purity) were mixed in a molar ratio of 1:1, and the mixture was calcined at 1100° C. under an Ar atmosphere for 4 days. Thereafter, the mixture was formed into pellets, and the pellets were sintered at 1100° C. for 2 days so that a sintered body was obtained. Thereafter, the sintered body is roughly grinded to several hundred μm, and the obtained course particles are finely grinded with a wet- and medium-type dispersing machine using a solvent so that $CuInO_2$ fine particles (3) having a number average primary particle size of 20 nm were obtained.

Into a wet sand mill (alumina beads, 0.5 mm diameter), 100 parts of the obtained fine particles (3), 30 parts of 3-methacryloxypropyltrimethoxysilane "KBM-503" (Shin-Etsu Chemical Co., Ltd.) as a surface treatment agent and 1000 parts of methyl ethyl ketone were charged, and they were mixed at 30° C. for 6 hours. Thereafter, the methyl ethyl ketone and the alumina beads were removed by filtration, and the filtrate was dried at 60° C. P-type semiconductor fine particles (3) were thus prepared.

Preparation of Photoreceptor 1

The surface of a 60 mm-diameter aluminum cylinder was machined so that an electrically conductive support (1) with a finely roughened surface was prepared.

"Forming Intermediate Layer"

A dispersion having the following composition was diluted 2 times with the following solvent, and was left still overnight. Thereafter, the dispersion was filtrated (filter: a RIGIMESH 5-μm filter (Japan Pall Corporation) was used) so that an intermediate layer forming coating fluid (1) was prepared.

Binder resin: 1 part of polyamide resin "CM8000" (Toray Industries, Inc.)

Metal oxide particles: 3 parts of titanium oxide "SMT500SAS" (Tayca Corporation)

Solvent: 10 parts of methanol

Using a sand mill as a dispersing machine, the coating fluid was dispersed for 10 hours by a batch process.

The intermediate layer forming coating fluid (1) was applied on the electrically conductive support (1) by immersion coating so that an intermediate layer (1) having a dry film thickness of 2 μm was formed.

"Forming Charge Generating Layer"

Y—TiPh (a titanylphthalocyanine pigment (a titanylphthalocyanine pigment having a maximum diffraction peak at least at 27.3°, measured by Cu—Kα characteristic X-radiation spectroscopy) (20 parts) as a charge generating material, 10 parts of polyvinylbutyral resin "#6000-C" (Denki Kagaku Kogyo Kabushiki Kaisha) as a binder resin, 700 parts of t-butyl acetate as a solvent, 300 parts of 4-methoxy-4-methyl-2-pentanone as a solvent were mixed together, and the mixture was dispersed with a sand mill for 10 hours so that a charge generating layer forming coating fluid (1) was prepared. The charge generating layer forming coating fluid (1) was applied on the intermediate layer (1) by immersion coating so that a charge generating layer (1) having a dry film thickness of 0.3 μm was formed.

"Forming Charge Transporting Layer"

4,4'-dimethyl-4"-(β-phenylstyryl)triphenylamine (225 parts) as a charge transporting material, 300 parts of polycarbonate resin "Z300" (Mitsubishi Gas Chemical, Inc.) as a binder resin, 6 parts of "IRGANOX 1010" (Nihon Chiba-Geigy K. K.) as an antioxidant, 1600 parts of THF (tetrahydrofuran) as a solvent, 400 parts of toluene as a solvent and 1 part of silicone oil "KF-50" (Shin-Etsu Chemical Co., Ltd.) was mixed and dissolved together so that a charge transporting layer forming coating fluid (1) was prepared. The charge transporting layer forming coating fluid (1) was applied on the charge generating layer (1) by immersion coating so that a charge transporting layer (1) having a dry film thickness of 20 μm was formed.

"Forming Surface Layer"

The N-type semiconductor fine particles (1) (120 parts), 5 parts of the P-type semiconductor fine particles (1), 100 parts of the above-described example compound "M1" as a polymerizable compound, 600 parts of 2-butanol as a solvent and 1000 parts of THF (tetrahydrofuran) as a solvent were mixed together in the dark, and the mixture was dispersed for 5 hours using a sand mill as a dispersing machine. Thereafter, 6 parts of "IRGACURE-819" (BASF Japan, Ltd.) as a polymerization initiator was added thereto, and the mixture was stirred in the dark to dissolve it so that a surface layer forming coating fluid (1) was prepared. The surface layer forming coating fluid (1) was applied on the charge transporting layer (1) with a circular slide hopper coater to form a coated film, and the coated film was irradiated with ultraviolet ray for 1 minute using a metal halide lamp, so that a surface layer (1) having a dry film thickness of 2.0 μm was formed. A photoreceptor (1) was thus prepared.

Preparation of Photoreceptor 2

A photoreceptor (2) was prepared in the same manner as Preparation of Photoreceptor 1 except that the amount of the P-type semiconductor fine particles (1) added was changed to 15 parts in forming the surface layer.

Preparation of Photoreceptor 3

A photoreceptor (3) was prepared in the same manner as Preparation of Photoreceptor 1 except that the amount of the P-type semiconductor fine particles (1) added was changed to 30 parts in forming the surface layer.

Preparation of Photoreceptor 4

A photoreceptor (4) was prepared in the same manner as Preparation of Photoreceptor 1 except that the amount of the P-type semiconductor fine particles (1) added was changed to 45 parts in forming the surface layer.

Preparation of Photoreceptor 5

A photoreceptor (5) was prepared in the same manner as Preparation of Photoreceptor 4 except that the N-type semiconductor fine particles (1) were changed to the N-type semiconductor fine particle (3) in forming the surface layer.

Preparation of Photoreceptor 6

A photoreceptor (6) was prepared in the same manner as Preparation of Photoreceptor 4 except that the N-type semiconductor fine particles (1) were changed to the N-type semiconductor fine particle (2) in forming the surface layer.

Preparation of Photoreceptor 7

A photoreceptor (7) was prepared in the same manner as Preparation of Photoreceptor 4 except that the P-type semiconductor fine particles (1) were changed to the P-type semiconductor fine particle (3) in forming the surface layer.

Preparation of Photoreceptor 8

A photoreceptor (8) was prepared in the same manner as Preparation of Photoreceptor 1 except that the amount of the P-type semiconductor fine particles (1) added was changed to 70 parts in forming the surface layer.

Preparation of Photoreceptor 9

A photoreceptor (9) was prepared in the same manner as Preparation of Photoreceptor 1 except that the amount of the P-type semiconductor fine particles (1) added was changed to 90 parts in forming the surface layer.

Preparation of Photoreceptor 10

A photoreceptor (10) was prepared in the same manner as Preparation of Photoreceptor 1 except that the amount of the P-type semiconductor fine particles (1) added was changed to 120 parts in forming the surface layer.

Preparation of Photoreceptor 11

A photoreceptor (11) was prepared in the same manner as Preparation of Photoreceptor 1 except that the P-type semiconductor fine particles (1) were not added in forming the surface layer.

Preparation of Photoreceptor 12

A photoreceptor (12) was prepared in the same manner as Preparation of Photoreceptor 11 except that 15 parts of the following compound (CTM-1) was added as a hole transporting organic compound in forming the surface layer.

CTM-1

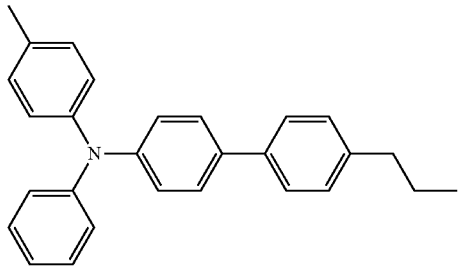

Preparation of Photoreceptor 13

A photoreceptor (13) was prepared in the same manner as Preparation of Photoreceptor 10 except that the N-type semiconductor fine particles (1) were not added in forming the surface layer.

Preparation of Photoreceptor 14

A photoreceptor (14) was prepared in the same manner as Preparation of Photoreceptor 3 except that 15 parts of the compound (CTM-1) was further added as a hole transporting organic compound in forming the surface layer.

Preparation of Photoreceptor 15

A photoreceptor (15) was prepared in the same manner as Preparation of Photoreceptor 4 except that the P-type semiconductor fine particles (1) were changed to the P-type semiconductor fine particle (2) in forming the surface layer.

Evaluation

Examples 1 to 12, Comparisons 1 to 3

The obtained photoreceptors (1) to (15) were evaluated in terms of surface hardness, residual potential after exposure and dot reproducibility.

To evaluate the residual potential after exposure and the dot reproducibility, each of the photoreceptors (1) to (15) was installed in an apparatus for evaluation "BIZHUB PRO C6501" (Konica Minolta, Inc.), which basically has the same configuration as the image forming apparatus illustrated in FIG. 1.

The exposure light source of the apparatus for evaluation "BIZHUB PRO C6501" was a semiconductor laser at a wavelength of 780 nm. As a durability test, an A4-size text image with an image ratio of 5% was continuously printed on both sides of 300000 sheets of A4 neutralized papers in a long-edge feeding mode under an environment of a temperature of 23° C. and a humidity of 50%. The photoreceptors were evaluated before and after the durability test. The results are shown in Table 2.

In the evaluations, the photoreceptors (1) to (10), (14) and (15) refer to Examples 1 to 12 respectively, and the photoreceptors (11) to (13) refer to Comparison 1 to 3 respectively.

(1) Evaluation of Surface Hardness

The surface hardness (universal hardness) was measured using "ultramicrohardness tester HM-2000" (Fischer Instruments Corp.). Regarding the measuring conditions, a 2 mN load was applied on the surface of each photoreceptor for 10 seconds. After 5-second creeping time, the tester was returned to an initial state at 2 mN for 10 seconds. When the film hardness is equal to or more than 150 $N/mm^2$, a photoreceptor exhibits acceptable durability.

(2) Evaluation of Residual Potential

An originally equipped pattern No. 53/Dot 1 (typical regular dot exposure pattern) was continuously printed on 100 sheets of A3/POD gloss coated paper (100 $g/m^2$, Oji Paper Co., Ltd) at a density setting of 255, and the potential difference ($\Delta V$) between the potential after exposure of the first sheet and the potential after exposure of the 100th sheet was measured. The potential difference ($\Delta V$) was measured before and after a durability test (i.e. in an initial condition and after an A4-size text image with an image ratio of 5% was continuously printed on both sides of 300000 sheets of A4 paper in a long-edge feeding mode) under a low-temperature low-humidity environment (a temperature of 10° C. and a humidity of 20% RH)). When the $\Delta V$ is less than 50, a photoreceptor is acceptable for practical use.

(3) Evaluation of Dot Reproducibility

An originally equipped pattern No. 53/Dot 1 (typical regular dot exposure pattern) was continuously printed on a sheet of A3/POD gloss coated paper (100 $g/m^2$, Oji Paper Co., Ltd) at a density setting of 100, and the condition of the formed dots was visually observed under magnification. The evaluation was made according to the following evaluation criteria. The observation under magnification was conducted before and after a durability test (i.e. in an initial condition and after an A4-size text image with an image ratio of 5% was continuously printed on both sides of 300000 sheets of A4 paper in a long-edge feeding mode) under a high-temperature high-humidity environment (a temperature of 30° C. and a humidity of 80% RH)).

Evaluation Criteria

◎: Dots are correctly formed. (Good)
○: Dots are slightly thinned. (Practically Acceptable)
Δ: Dots are thinned. (Practically Acceptable)
x: Dots are not formed. (Practically Unacceptable)

TABLE 1

| | PHOTORECEPTOR No. | N-TYPE SEMICONDUCTOR FINE PARTICLES No. | N-TYPE SEMICONDUCTOR FINE PARTICLES AMOUNT ADDED (X1) (parts by mass) | P-TYPE SEMICONDUCTOR FINE PARTICLES No. | P-TYPE SEMICONDUCTOR FINE PARTICLES AMOUNT ADDED (X2) (parts by mass) | CTM-1 AMOUNT ADDED (parts by mass) | X2/X1 | HARDNESS ($N/mm^2$) |
|---|---|---|---|---|---|---|---|---|
| EXAMPLE 1 | PHOTORECEPTOR [1] | [1] | 120 | [1] | 5 | — | 0.04 | 250 |
| EXAMPLE 2 | PHOTORECEPTOR [2] | [1] | 120 | [1] | 15 | — | 0.13 | 255 |
| EXAMPLE 3 | PHOTORECEPTOR [3] | [1] | 120 | [1] | 30 | — | 0.25 | 260 |
| EXAMPLE 4 | PHOTORECEPTOR [14] | [1] | 120 | [1] | 30 | 15 | 0.25 | 240 |
| EXAMPLE 5 | PHOTORECEPTOR [4] | [1] | 120 | [1] | 45 | — | 0.38 | 280 |
| EXAMPLE 6 | PHOTORECEPTOR [5] | [3] | 120 | [1] | 45 | — | 0.38 | 270 |
| EXAMPLE 7 | PHOTORECEPTOR [6] | [2] | 120 | [1] | 45 | — | 0.38 | 270 |
| EXAMPLE 8 | PHOTORECEPTOR [7] | [1] | 120 | [3] | 45 | — | 0.38 | 280 |
| EXAMPLE 9 | PHOTORECEPTOR [8] | [1] | 120 | [1] | 70 | — | 0.58 | 300 |
| EXAMPLE 10 | PHOTORECEPTOR [9] | [1] | 120 | [1] | 90 | — | 0.75 | 320 |
| EXAMPLE 11 | PHOTORECEPTOR [10] | [1] | 120 | [1] | 120 | — | 1.00 | 340 |
| EXAMPLE 12 | PHOTORECEPTOR [15] | [1] | 120 | [2] | 45 | — | 0.38 | 280 |
| COMPARISON 1 | PHOTORECEPTOR [11] | [1] | 120 | — | — | — | — | 250 |
| COMPARISON 2 | PHOTORECEPTOR [12] | [1] | 120 | — | — | 15 | — | 200 |
| COMPARISON 3 | PHOTORECEPTOR [13] | — | — | [1] | 120 | — | — | 270 |

| | INITIAL L/L ENVIRONMENT ΔVi(−V) | INITIAL H/H ENVIRONMENT DOT REPRODUCIBILITY | AFTER 300x PRINTING L/L ENVIRONMENT ΔVi(−V) | AFTER 300x PRINTING H/H ENVIRONMENT DOT REPRODUCIBILITY |
|---|---|---|---|---|
| EXAMPLE 1 | 47 | Δ | 49 | Δ |
| EXAMPLE 2 | 32 | ○ | 35 | ○ |
| EXAMPLE 3 | 24 | ○ | 27 | ○ |
| EXAMPLE 4 | 18 | ○ | 30 | Δ |
| EXAMPLE 5 | 15 | ◎ | 17 | ◎ |
| EXAMPLE 6 | 24 | ○ | 26 | ○ |
| EXAMPLE 7 | 27 | ○ | 29 | ○ |
| EXAMPLE 8 | 18 | ◎ | 20 | ◎ |
| EXAMPLE 9 | 13 | ◎ | 14 | ◎ |
| EXAMPLE 10 | 11 | ○ | 12 | ○ |
| EXAMPLE 11 | 9 | Δ | 10 | Δ |
| EXAMPLE 12 | 17 | ◎ | 19 | ◎ |
| COMPARISON 1 | 55 | Δ | 57 | Δ |
| COMPARISON 2 | 38 | ○ | 52 | Δ |
| COMPARISON 3 | 35 | X | 37 | X |

As seen from the results in Table 1, it was confirmed that Examples 1 to 12 of the present invention maintain the residual potential after exposure at a low level even after repeated use and also has high film hardness since the surface layer contains the resin produced by polymerizing the cross-linkable polymerizable compound, the N-type semiconductor fine particles and the P-type semiconductor fine particles. Further, good results were also obtained in dot reproducibility.

In contrast, in Comparison 1, it was confirmed that the electron transporting function becomes dominant, and negative charges left in the surface layer increase the residual potential, since it contains only the N-type semiconductor fine particles.

In Comparison 2, it was confirmed that the residual potential is initially kept at a low level, but an increase in residual potential cannot be suppressed after repeated use, since it contains the N-type semiconductor fine particles and an organic compound having a hole transporting function. It was also confirmed that the film hardness is not sufficiently high.

In Comparison 3, it was confirmed that while it has the hole transporting function, the effect is poor since it contains only the P-type semiconductor fine particles. Further, the dot reproducibility is insufficient.

This U.S. patent application claims priority to Japanese patent application No. 2014-051309 filed on Mar. 14, 2014, the entire contents of which are incorporated by reference herein for correction of incorrect translation.

What is claimed is:

1. An electrophotographic photoreceptor comprising an electrically conductive support, a photosensitive layer formed on the electrically conductive support and a surface layer formed on the photosensitive layer, wherein the surface layer contains a resin produced by polymerizing a cross-linkable polymerizable compound, N-type semiconductor fine particles and P-type semiconductor fine particles, and wherein in the surface layer, a mass ratio of the P-type semiconductor fine particles to the N-type semiconductor fine particles (part by mass of the P-type semiconductor fine particles/part by mass of the N-type semiconductor fine particles) is within a range of 0.1 to 0.8.

2. The electrophotographic photoreceptor according to claim 1, wherein the N-type semiconductor fine particles are constituted by $SnO_2$, and the P-type semiconductor fine particles are constituted by $CuMO_2$, where M is Al, Ga or In.

3. The electrophotographic photoreceptor according to claim 1, wherein the N-type semiconductor fine particles are constituted by any one of $SnO_2$, $TiO_2$ and $Al_2O_3$.

4. The electrophotographic photoreceptor according to claim 1, wherein the N-type semiconductor fine particles are constituted by $SnO_2$.

5. The electrophotographic photoreceptor according to claim 1, wherein a number average primary particle size of the N-type semiconductor fine particles is within the range of 1 to 300 nm.

6. The electrophotographic photoreceptor according to claim 1, wherein the N-type semiconductor fine particles are contained in an amount of 30 to 250 parts by mass with respect to 100 parts by mass of a surface layer binder resin.

7. The electrophotographic photoreceptor according to claim 1, wherein the P-type semiconductor fine particles are constituted by $CuMO_2$, where M is Al, Ga or In.

8. The electrophotographic photoreceptor according to claim 1, wherein the P-type semiconductor fine particles are constituted by $CuAlO_2$.

9. The electrophotographic photoreceptor according to claim 1, wherein a number average primary particle size of the P-type semiconductor fine particles is within the range of 1 to 300 nm.

10. The electrophotographic photoreceptor according to claim 1, wherein the P-type semiconductor fine particles are contained in an amount of 1 to 250 parts by mass with respect to 100 parts by mass of a surface layer binder resin.

11. The electrophotographic photoreceptor according to claim 1, wherein in the surface layer, the mass ratio of the P-type semiconductor fine particles to the N-type semiconductor fine particles (part by mass of the P-type semiconductor fine particles/part by mass of the N-type semiconductor fine particles) is within a range of 0.2 to 0.7.

* * * * *